US006951408B2

(12) United States Patent
Stewart

(10) Patent No.: US 6,951,408 B2
(45) Date of Patent: Oct. 4, 2005

(54) CEMETERY MONUMENT ILLUMINATOR

(76) Inventor: Timothy Wayne Stewart, 11623 Windy La., Forney, TX (US) 75126

( * ) Notice: Subject to any disclaimer, the term of this patent is extended or adjusted under 35 U.S.C. 154(b) by 217 days.

(21) Appl. No.: 10/249,905

(22) Filed: May 16, 2003

(65) Prior Publication Data

US 2004/0228123 A1 Nov. 18, 2004

(51) Int. Cl.[7] ..... F21V 33/00

(52) U.S. Cl. ..... 362/183; 362/190; 362/253; 362/396; 362/287

(58) Field of Search ..... 362/183, 253, 362/190, 191, 287, 199, 396, 427; 248/313, 231.41; 52/103, 104

(56) References Cited

U.S. PATENT DOCUMENTS 4,319,310 A 3/1982 Kingsley
4,787,017 A 11/1988 Vrettos
5,013,972 A 5/1991 Malkieli et al.
5,014,472 A 5/1991 Svensson
5,159,191 A * 10/1992 Mankovitz ..... 250/229
5,253,150 A * 10/1993 Vanni ..... 362/183
5,255,170 A 10/1993 Plamp et al.
5,564,816 A 10/1996 Arcadia et al.
5,664,874 A * 9/1997 Winterer ..... 362/191
5,980,064 A 11/1999 Metroyanis
6,132,054 A 10/2000 Rogers et al.
6,263,601 B1 * 7/2001 Emert ..... 40/564
6,364,503 B1 4/2002 Wenzel et al.
6,520,606 B1 2/2003 Robinson
6,761,465 B2 * 7/2004 Little ..... 362/183

* cited by examiner

*Primary Examiner*—Thomas M. Sember
(74) *Attorney, Agent, or Firm*—Daniel V. Thompson

(57) ABSTRACT

A cemetery monument illuminator includes a lamp hood, at least one lamp partially enclosed by the lamp hood, a monument clamp fixed to the lamp hood, a solar panel attached to the monument clamp, and electronic circuit elements electrically connected to the at least one lamp and the solar panel, with the electronic circuit elements adapted and arranged to store energy generated by the solar panel, sense darkness exterior to the illuminator, and supply energy to the at least one lamp when darkness is sensed.

16 Claims, 4 Drawing Sheets

CEMETERY MONUMENT ILLUMINATOR

BACKGROUND OF INVENTION

1. Field of the Invention

The present invention relates to cemetery monuments. More particularly, the present invention relates to a cemetery monument illuminator with a solar panel that enables the device to recharge its own power source during the day, whereby the power source maintains the illumination of a light source at night.

2. Statement of the Prior Art

Many cultures use monuments at grave sites to memorialize the dead. A common such monument is the tombstone wherein the person's name, date of birth, date of death and perhaps a brief personal message are carved into the stone. Due to religious beliefs and/or superstition, cemeteries are commonly considered places to be avoided at night or during inclement weather conditions. One of the reasons that may have lead to this fearful reputation is that cemeteries are often not well lit. As such, during the night and during inclement weather, cemeteries appear dark, dreary and uninviting. Because cemeteries are not well lit, cemeteries have often become subject to vandalism, wherein tombstones have been desecrated, damaged or toppled.

One of the primary reasons that cemeteries are not well lit is that cemeteries typically are not wired for electricity to a public utility. As a result, no electrical power for lighting is available. Another reason why lights are not present in cemeteries is that cemeteries are often very large and the cost of lighting such a large area is prohibitively expensive to a cemetery with limited financial resources.

In the prior art, there have been many devices invented that are intended to bring light to remote locations were there is no access to the public electric utility. Many of these prior art devices are solar powered units that charge batteries during the day and light a light during the night.

SUMMARY OF INVENTION

A cemetery monument illuminator includes a lamp hood, at least one lamp partially enclosed by the lamp hood, a monument clamp fixed to the lamp hood, a solar panel attached to the monument clamp, and electronic circuit elements electrically connected to the at least one lamp and the solar panel, with the electronic circuit elements adapted and arranged to store energy generated by the solar panel, sense darkness exterior to illuminator, and supply energy to the at least one lamp when darkness is sensed.

BRIEF DESCRIPTION OF DRAWINGS

A more complete understanding of the invention and its advantages will be apparent from a review of the Detailed Description in conjunction with the following Drawings, in which.

DETAILED DESCRIPTION

Figure 1:
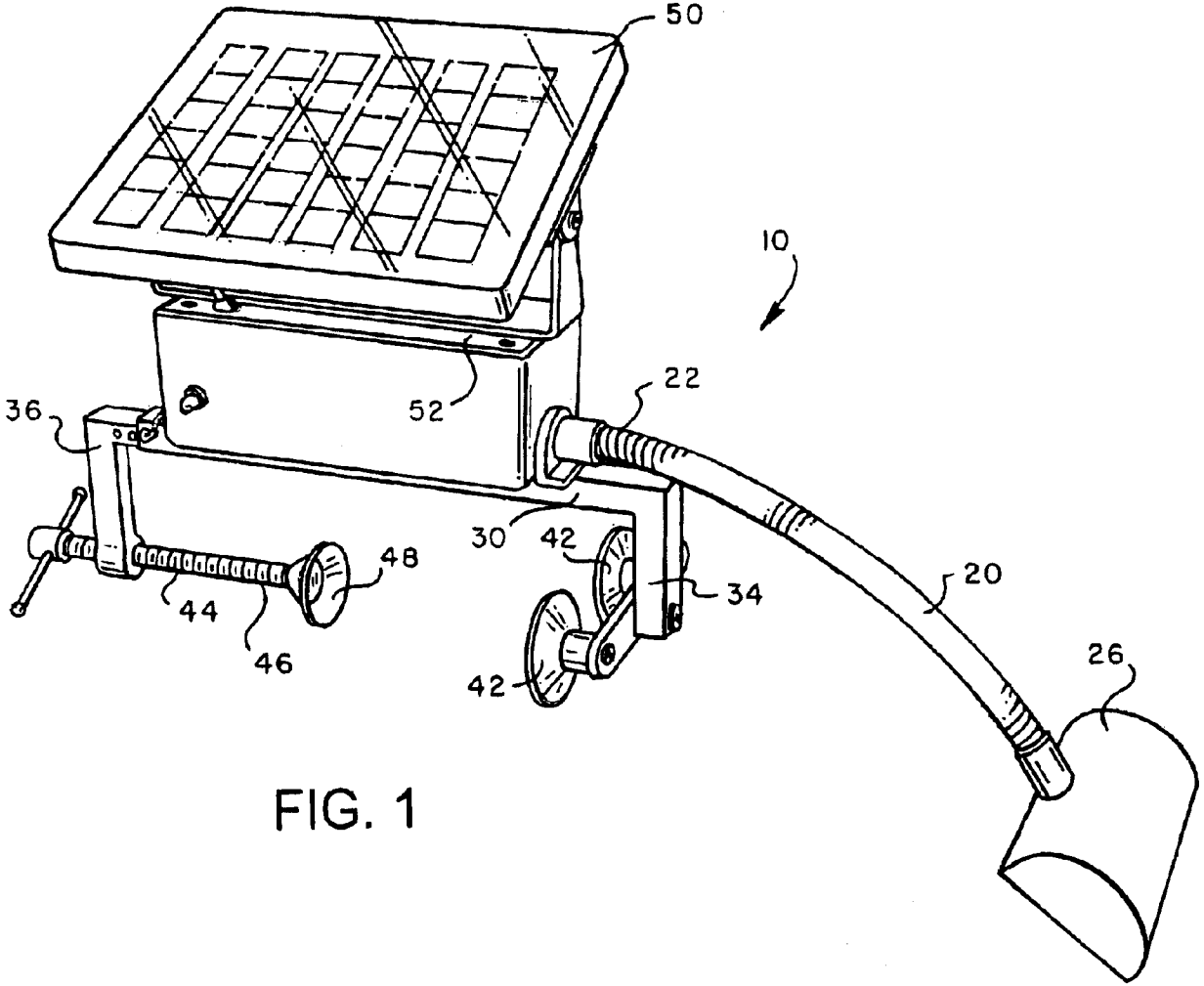
FIG. 1 is a perspective view of the apparatus of the present invention.
Figure 2:
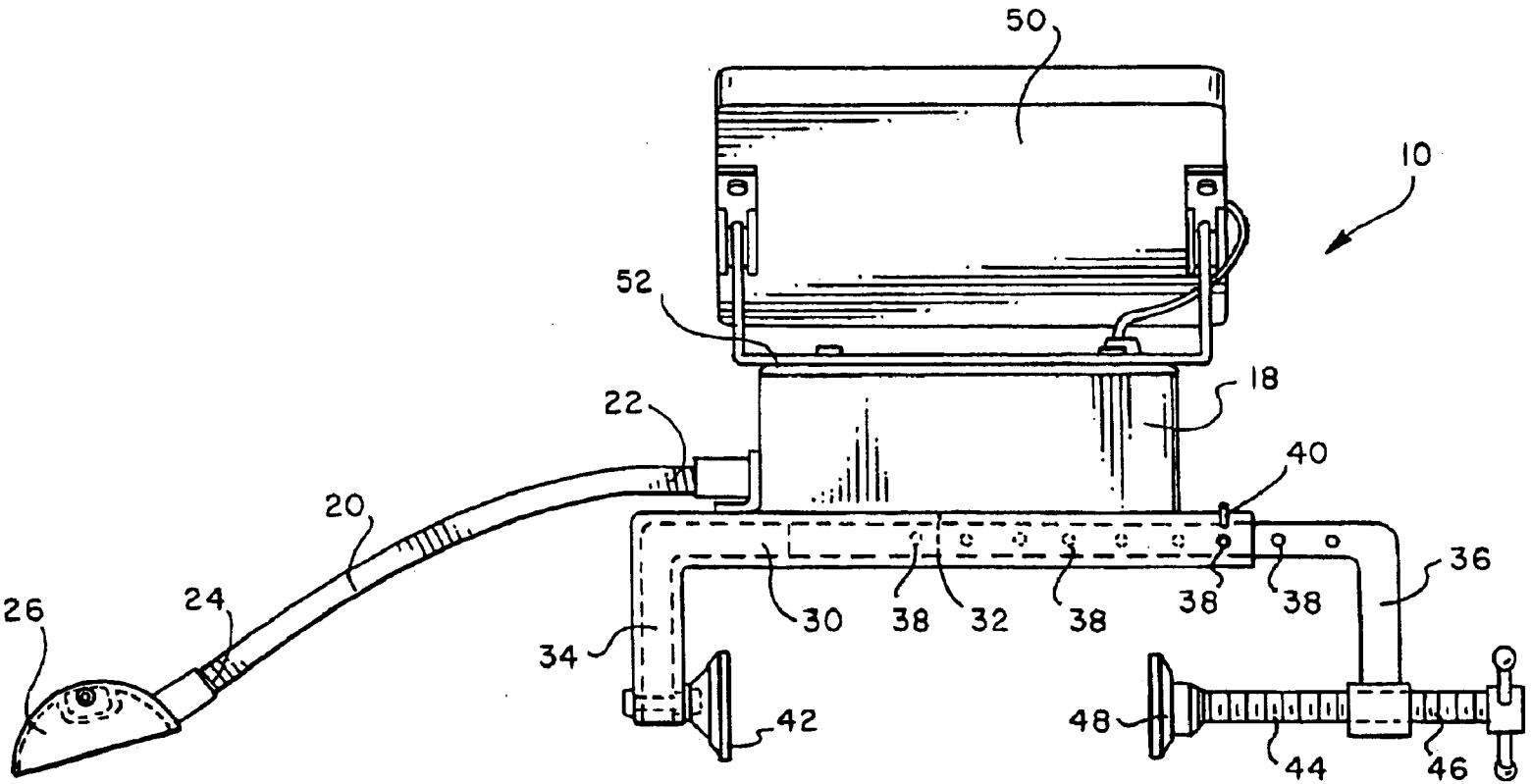
FIG. 2 is a side view.
Figure 3:
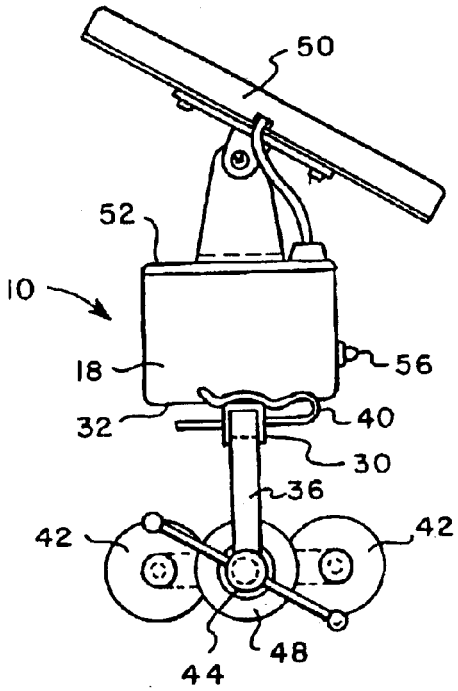
FIG. 3 is an end view.
Figure 4:
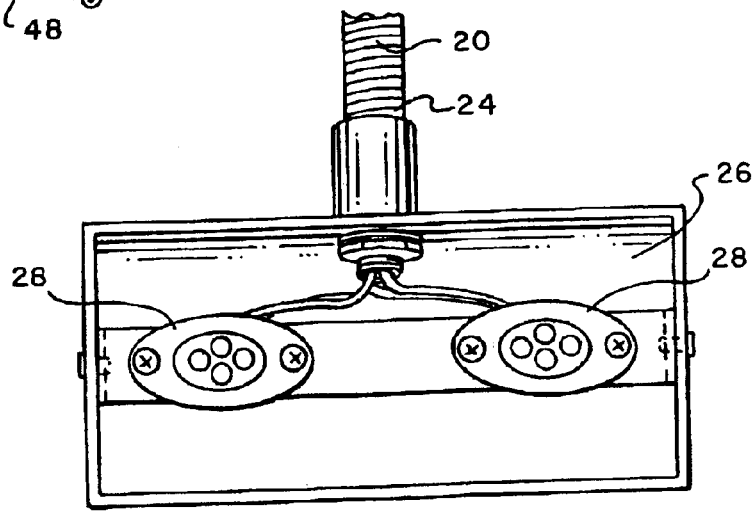
FIG. 4 is a view underneath the lamp hood.
Figure 5:
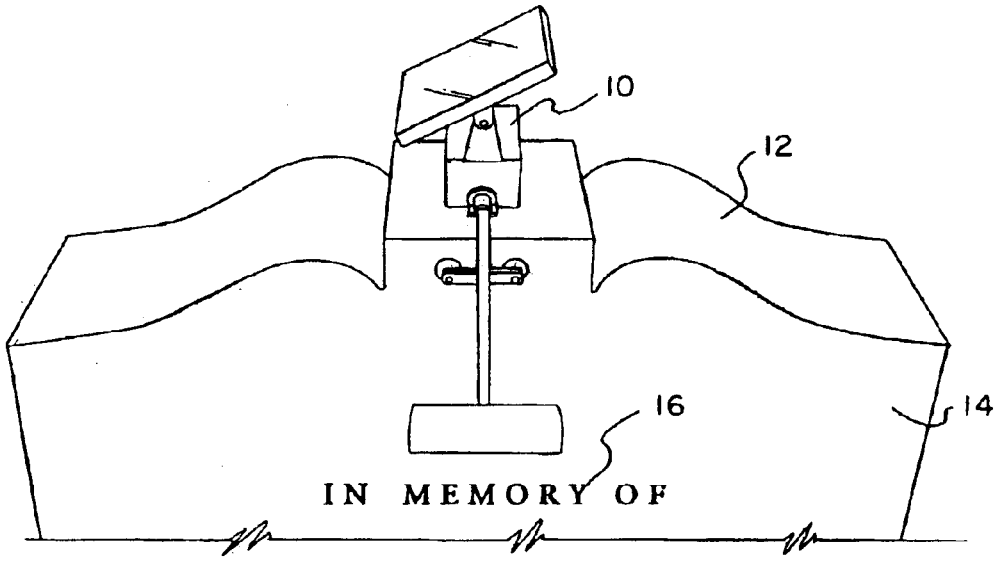
FIG. 5 is a perspective view of the invention in use.

Referring initially to FIGS. 1–5, where like numerals indicate like and corresponding elements a cemetery monument illuminator 10 is attached to a monument 12 (FIG. 5) such that it will illuminate the face 14 of monument 12 having inscription text 16.

Cemetery monument illuminator 10 includes an enclosure box 18. A flexible conduit 20 has two ends 22,24, connected at one end 22 to the enclosure box 18 and extending from the enclosure box 18 to the other end 24. A lamp hood 26 is fixed to the other end 24 of the conduit 20. A plurality of LED lamps 28 are partially enclosed by the lamp hood 26.

A monument clamp 30 is fixed to a bottom surface 32 of the enclosure box 18. The monument clamp 30 includes a fixed arm 34 and an adjustable arm 36. The adjustable arm 36 is adjustable in length to adapt to different thicknesses of monuments. Specifically, the adjustable arm 36 is adjustable by way of the adjustable arm 36 being telescopically-engaged with the fixed arm 34, with the length of the adjustable arm 36 being selectable by alignment of ones of a plurality of spaced pairs 38 of apertures in the adjustable arm 36 and fixed arm 34. A pin 40 is inserted into the selected ones of spaced pairs of apertures 38 to fix the adjustable arm 36 with respect to fixed arm 34.

At least one, and preferably two laterally-spaced, monument engagement elements are attached to the fixed arm 34. A lengthwise-extendable clamping mechanism 44 is fixed to the adjustable arm 36. The clamping mechanism 44 includes a threaded ram 46, with another monument engagement element 48 attached to the threaded ram 46.

A solar panel 50 is pivotally attached to a top surface 52 of the enclosure box 18. In the preferred embodiment, the monument engagement elements 42,48 are resilient suction cups.

Figure 6:
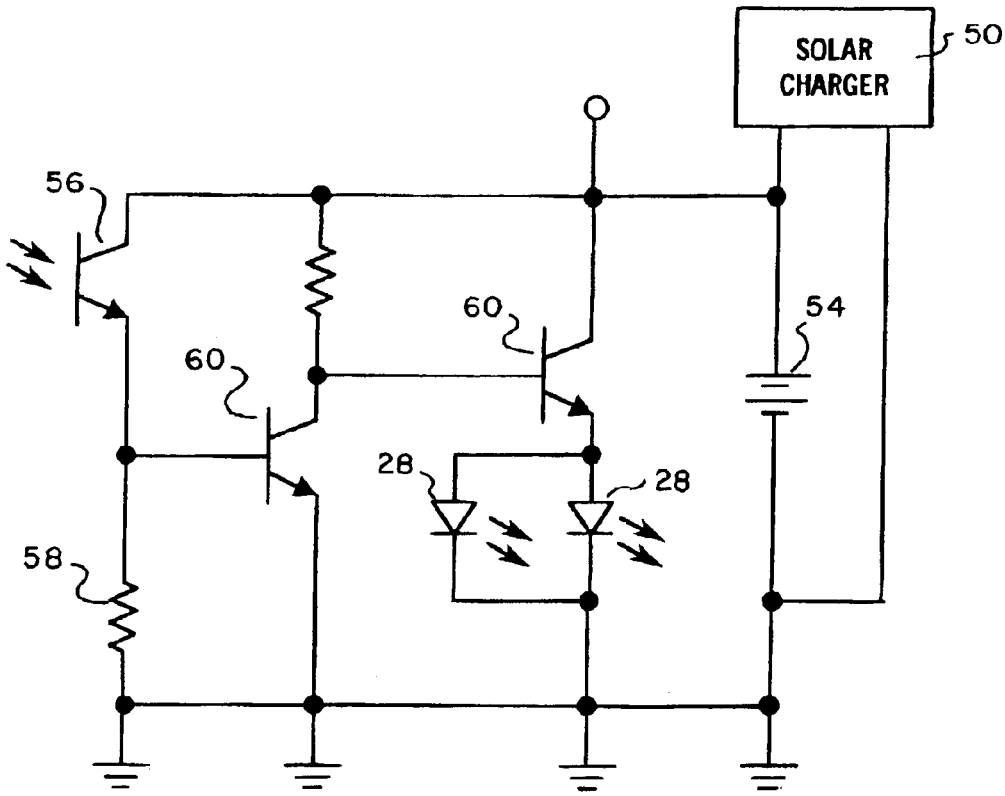
FIG. 6 is a circuit diagram.

Referring now additionally to FIG. 6, electronic circuit elements within the enclosure box 18 are electrically connected to the LED lamps 28 and the solar panel 50. The electronic circuit elements are adapted and arranged to store energy generated by the solar panel 50, sense darkness exterior to the enclosure box 18, and supply energy to the LED lamps 28 when darkness is sensed. The electronic circuit elements include battery 54 connected for charging during the day by solar panel 50. In daylight, phototransistor 56 (FIGS. 3 and 6) conducts to ground through resistor 58 and causes switching transistor 60 to conduct, thereby shutting off switching transistor 62 connected to LED lamps 28. At night, the status of phototransistor 56 and switching transistors 62, 64 are reversed, causing LED lamps 28 to turn on.

In operation, the cemetery monument illuminator is adaptable to a wide range of monument thicknesses. Adjustable arm 36 is initially telescoped so the monument engagement elements 42,48 are close to contact with the monument 12 with the threaded ram 46 at least partially withdrawn. A pair of aligned apertures 38 are selected, and pin 40 is inserted. Then threaded ram 46 is operated to permit secure engagement of the monument 12. The laterally-spaced pair of monument engagement elements 42 enable the monument clamp 30 to squarely engage the monument 12. Solar panel 50 is then pivoted such that the panel faces in a southerly direction (in the northern hemisphere) to maximize charging capability. The charging output of solar panel 50, capacity of battery 54, and power consumption of LED lamps 28 are selected to permit all-night operation of the lamps even after a period of cloudy days, in a selection process that is well-known and within routine experimentation to those skilled in the art.

While the invention has been illustrated and described as embodied in a compact evaporation apparatus, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

Whereas, the present invention has been described with respect to a specific embodiment thereof, it will be understood that various changes and modifications will be suggested to one skilled in the art and it is intended to encompass such changes and modifications as fall within the scope of the appended claims.

What is claimed is:

1. A cemetery monument illuminator, comprising:

a lamp hood;

at least one lamp partially enclosed by the lamp hood;

a monument clamp fixed to the lamp hood;

a solar panel attached to the monument clamp;

electronic circuit elements within the enclosure box electrically connected to the at least one lamp and the solar panel, with the electronic circuit elements adapted and arranged to store energy generated by the solar panel, sense darkness exterior to the enclosure box, and supply energy to the at least one lamp when darkness is sensed; and with a flexible conduit interposed between the lamp hood and the monument clamp.

2. A cemetery monument illuminator, comprising:

a lamp hood:

at least one lamp partially enclosed by the lamp hood;

a monument clamp fixed to the lamp hood;

a solar panel attached to the monument clamp;

electronic circuit elements within the enclosure box electrically connected to the at least one lamp and the solar panel, with the electronic circuit elements adapted and arranged to store energy generated by the solar panel, sense darkness exterior to the enclosure box, and supply energy to the at least one lamp when darkness is sensed;

with an enclosure box interposed between the lamp hood and the monument clamp; and with a flexible conduit interposed between the lamp hood and the enclosure box.

3. The apparatus of claim 2 with the conduit having two ends, connected at one end to the enclosure box and extending from the enclosure box to the other end.

4. The apparatus of claim 3 with a lamp hood fixed to the other end of the conduit.

5. A cemetery monument illuminator, comprising:

a lamp hood;

at least one lamp partially enclosed by the lamp hood;

a monument clamp fixed to the lamp hood;

a solar panel attached to the monument clamp;

electronic circuit elements within the enclosure box electrically connected to the at least one lamp and the solar panel, with the electronic circuit elements adapted and arranged to store energy generated by the solar panel, sense darkness exterior to the enclosure box, and supply energy to the at least one lamp when darkness is sensed; and with the monument clamp including a fixed arm and an adjustable arm, the adjustable arm being adjustable in length to adapt to different thicknesses of monuments.

6. The apparatus of claim 5 with at least one monument engagement element attached to the fixed arm.

7. The apparatus of claim 6 with at least one two laterally-spaced monument engagement elements attached to the fixed arm.

8. The apparatus of claim 5 with a lengthwise-extendable clamping mechanism fixed to the adjustable arm.

9. The apparatus of claim 8 with the clamping mechanism including a threaded ram.

10. The apparatus of claim 9 with at least one monument engagement element attached to the threaded ram.

11. A cemetery monument illuminator, comprising:

a lamphood;

at least one lamp partially enclosed by the lamp hood;

a monument clamp fixed to the lamp hood;

a solar panel attached to the monument clamp;

electronic circuit elements within the enclosure box electrically connected to the at least one lamp and the solar panel, with the electronic circuit elements adapted and arranged to store energy generated by the solar panel, sense darkness exterior to the enclosure box, and supply energy to the at least one lamp when darkness is sensed; and with the solar panel pivotally attached to the monument clamp.

12. A cemetery monument illuminator, comprising:

a lamp hood;

at least one lamp partially enclosed by the lamp hood;

a monument clamp fixed to the lamp hood;

a solar panel attached to the monument clamp;

electronic circuit elements within the enclosure box electrically connected to the at least one lamp and the solar panel, with the electronic circuit elements adapted and arranged to store energy generated by the solar panel, sense darkness exterior to the enclosure box, and supply energy to the at least one lamp when darkness is sensed;

with an enclosure box interposed between the lamp hood and the monument clamp; and with the solar panel pivotally attached to a top surface of the enclosure box.

13. A cemetery monument illuminator, comprising:

an enclosure box;

a flexible conduit having two ends, connected at one end to the enclosure box and extending from the enclosure box to the other end;

a lamp hood fixed to the other end of the conduit;

a plurality of LED lamps partially enclosed by the lamp hood;

a monument clamp fixed to a bottom surface of the enclosure box;

the monument clamp including a fixed arm and an adjustable arm, the adjustable arm being adjustable in length to adapt to different thicknesses of monuments;

two laterally-spaced monument engagement elements attached to the fixed arm;

a lengthwise-extendable clamping mechanism fixed to the adjustable arm, the clamping mechanism including a threaded ram;

a monument engagement element attached to the threaded ram;

a solar panel pivotally attached to a top surface of the enclosure box; and electronic circuit elements within the enclosure box electrically connected to the LED lamps and the solar panel, with the electronic circuit elements adapted and arranged to store energy generated by the solar panel, sense darkness exterior to the enclosure box, and supply energy to the LED lamps when darkness is sensed.

14. The apparatus of claim 13 with the monument engagement elements being suction cups.

15. The apparatus of claim 13 with the adjustable arm being adjustable by way of the adjustable arm being telescopically-engaged with the fixed arm, with the length of the adjustable arm being selectable by alignment of ones of a plurality of spaced pairs of apertures in the adjustable arm and fixed arm, and with a pin inserted into the selected ones of spaced pairs of apertures.

16. A cemetery monument illuminator, comprising:

an enclosure box;

a flexible conduit having two ends, connected at one end to the enclosure box and extending from the enclosure box to the other end;

a lamp hood fixed to the other end of the conduit;

a plurality of LED lamps partially enclosed by the lamp hood;

a monument clamp fixed to a bottom surface of the enclosure box;

the monument clamp including a fixed arm and an adjustable arm, the adjustable arm being adjustable in length to adapt to different thicknesses of monuments;

two laterally-spaced monument engagement elements attached to the fixed arm;

a lengthwise-extendable clamping mechanism fixed to the adjustable arm, the clamping mechanism including a threaded ram;

a monument engagement element attached to the threaded ram;

a solar panel pivotally attached to a top surface of the enclosure box; and electronic circuit elements within the enclosure box electrically connected to the LED lamps and the solar panel, with the electronic circuit elements adapted and arranged to store energy generated by the solar panel, sense darkness exterior to the enclosure box, and supply energy to the LED lamps when darkness is sensed;

with the monument engagement elements being suction cups; and with the adjustable arm being adjustable by way of the adjustable arm being telescopically-engaged with the fixed arm, with the length of the adjustable arm being selectable by alignment of ones of a plurality of spaced pairs of apertures in the adjustable arm and fixed arm, and with a pin inserted into the selected ones of spaced pairs of apertures.

* * * * *